US011172778B2

(12) United States Patent
Qi et al.

(10) Patent No.: US 11,172,778 B2
(45) Date of Patent: Nov. 16, 2021

(54) MAILBOX AND CONTROL SYSTEM THEREOF

(71) Applicant: Shuting Qi, Xinjiang (CN)

(72) Inventors: Yue Qi, Xinjiang (CN); Shuting Qi, Xinjiang (CN)

(73) Assignee: Shuting Qi, Xinjiang (CN)

( * ) Notice: Subject to any disclaimer, the term of this patent is extended or adjusted under 35 U.S.C. 154(b) by 0 days.

(21) Appl. No.: 16/811,143

(22) Filed: Mar. 6, 2020

(65) Prior Publication Data

US 2021/0259450 A1 Aug. 26, 2021

(30) Foreign Application Priority Data

Feb. 26, 2020 (CN) ..... 202010118890.1

(51) Int. Cl.
*A47G 29/22* (2006.01)
*A47G 29/14* (2006.01)
*A47G 29/124* (2006.01)

(52) U.S. Cl.
CPC ..... *A47G 29/22* (2013.01); *A47G 29/1251* (2017.08); *A47G 29/141* (2013.01); *A47G 2029/145* (2013.01); *A47G 2029/149* (2013.01)

(58) Field of Classification Search
CPC .. A47G 29/22; A47G 29/141; A47G 29/1248; A47G 29/1251; A47G 29/1254; A47G 29/1214; A47G 29/16; A47G 2029/145; A47G 2029/148; A47G 2029/149
USPC ..... 232/17, 19, 38, 45, 47, 49–52; 340/569, 340/568.1, 5.73
See application file for complete search history.

(56) References Cited

U.S. PATENT DOCUMENTS 6,318,628 B1 * 11/2001 Pangburn ..... A47G 29/1209 232/17
6,719,195 B2 * 4/2004 Farentinos ..... A47G 29/22 232/45
7,320,427 B2 * 1/2008 Prestwich ..... A47G 29/16 232/45
7,428,980 B2 * 9/2008 Irwin ..... E05G 7/001 232/45
7,946,472 B2 * 5/2011 Bolles ..... A47G 29/22 232/45
8,573,473 B1 * 11/2013 Farentinos ..... A47G 29/22 232/51
9,004,346 B2 * 4/2015 Farentinos ..... A47G 29/22 232/43.3

(Continued)

*Primary Examiner* — William L Miller
(74) *Attorney, Agent, or Firm* — McClure, Qualey & Rodack, LLP

(57) ABSTRACT

A mailbox and control system thereof includes a mailbox, and flip door provided thereon; a second drop slot is provided on the flip door, inside the mailbox is provided storage cavity for parcel storage; the flip door can be swung and open the storage cavity, wherein: on top of the storage cavity is provided a drop bucket, which is connected to the flip door by a transmission device, and by swinging the flip door it is possible to drive the drop bucket above the storage cavity. In the present invention, existing fixed drop slot structure is changed and by the swingable flip door, parcels can be put into the storage cavity by swinging the flip door until parcels are allowed in, meanwhile, the storage cavity is covered when the drop bucket is driven by the transmission mechanism, to limit parcels in, improve mailing safety.

2 Claims, 3 Drawing Sheets

(56) References Cited

U.S. PATENT DOCUMENTS

| | | | | |
|---|---|---|---|---|
| 10,251,503 | B1 * | 4/2019 | Fulps | A47G 29/12 |
| 10,517,417 | B2 * | 12/2019 | Kutas | A47G 29/1251 |
| 2017/0286905 | A1 * | 10/2017 | Richardson | G06Q 10/0836 |

* cited by examiner

MAILBOX AND CONTROL SYSTEM THEREOF

TECHNICAL FIELD

The present invention relates to the technical field of mail collection device, especially to a novel mailbox and control system thereof.

BACKGROUND TECHNOLOGY

Informatization is a kind of technology based on modern communication, network, and database technologies, which summarizes elements of objects of interest into a database for specific groups of people to live, work, study, and assist in decision-making, and combines all kinds of behaviors closely related to human beings. Modern society is an informatized society, and information communication plays an important role in life.

Traditional information communication utilizes mailbox, while conventional mailbox has a drop slot of fixed size, and in communication directly with the mailbox, in this regard, a large sized parcel cannot be dropped in, and what's more, it is susceptible for lawless persons to extract the mails with pliers or the like and mail loss happens. In addition, traditional mailboxes can be used only to receive letters, newspapers or magazines. But with the development of the society, especially the express industry, a mailbox that may receive parcels is in demand.

SUMMARY OF THE INVENTION

The object of the present invention is to address the problems in the prior art, and provide a novel mailbox and control system thereof by which express can be delivered and mail loss can be avoided, increase the security factor.

To achieve the above object, the present invention provides a novel mailbox, including a mailbox and a flip door arranged on the mailbox, the mailbox is internally provided with a storage cavity for storing mails, the flip door is capable of swinging and opening the storage cavity, wherein a drop bucket is swingably provided above the storage cavity, the drop bucket and the flip door are connected via a transmission mechanism, and when the flip door is swung, the drop bucket could be driven to cover the storage cavity.

Preferably, the transmission mechanism includes a pair of symmetrically arranged connection rods, one end of the connection rod is rotatably connected with the flip door, and the other end to the drop bucket; when the flip door is swung, the drop bucket could be driven by the connection rod to swing.

Preferably, wherein the drop bucket includes a baffle plate and connection pieces provided on both sides of the baffle plate, the connection pieces are swingably connected to the side walls of the mailbox through drop bucket supports.

Preferably, the storage cavity is internally provided with tension springs which may retrieve the drop bucket after swinging away, one end of the tension springs is connected to the drop bucket support, and the other end thereof to the connection pieces on the drop bucket, and when the drop bucket is swung, the tension springs could be stretched.

As a preferred embodiment, the bottom of the flip door is swingably fixed on the mailbox via a rotating shaft, and when the flip door is swung, a drop slot is formed between the top of the flip door and the mailbox.

Preferably, a second drop slot is provided on the flip door.

Preferably, a limit bracket is provided on each connection piece to prevent it from protruding out of the storage cavity.

The beneficial effects of the present invention are as follows: compared to the prior art, in the present invention, the existing fixed sized drop slot structure is changed and by the swingable flip door, mail can be put into the storage cavity by swinging the flip door according to size of mail, in the meantime, the storage cavity is covered when the drop bucket is driven by the transmission mechanism, to limit the mail inside the cavity, prevent mail loss and improve mailing safety.

The features and advantages of the present invention will be described in detail through embodiments with reference to the accompanying drawings.

Figure 1:
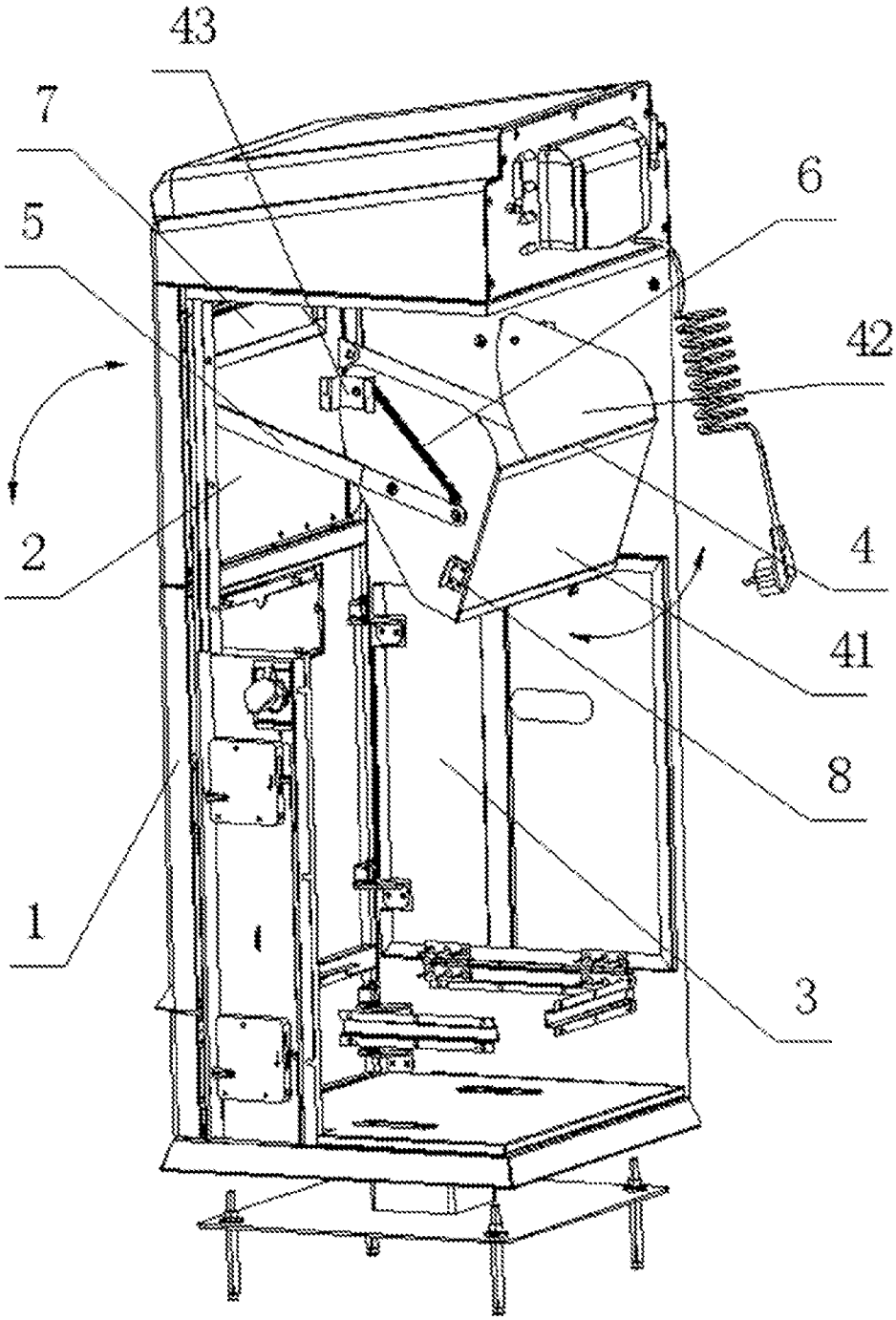
FIG. 1 is a schematic structural view of the mailbox according to the present invention.

The text markup shown in the drawings are as follows:

1—mailbox, 2—flip door, 3—storage cavity, 4—drop bucket, 5—connection rod, 6—tension spring, 7—second drop slot, 8—limit bracket, 41—baffle plate, 42—connection piece, 43—drop bucket support.

With reference to the accompanying drawings and the following specific embodiments, the above and other features, advantages and aspects of embodiments of the present disclosure will become more apparent. Like or similar reference numbers and designations in the various drawings indicate like or similar elements. It shall be understood that the accompanying drawings are merely illustrative, and elements and objects are not necessarily drawn to scale.

SPECIFIC EMBODIMENTS

The implementations of the present invention will be discussed more detailed with reference to the accompanying drawings. It should be understood that although some embodiments of the present invention are explained in the drawings, it shall not be construed as limiting to the embodiments given here, on the contrary, these embodiments are described to aid in the complete and thorough understanding of the present disclosure. It should be understood that the drawings and embodiments given here are merely exemplary, instead of limiting scope of the present disclosure.

The term "includes" and its synonyms used in the description means "including but not limited to". The term "based on" means "at least partially based on". The term "one embodiment" means "at least one embodiment"; the term "another embodiment" means "at least another embodiment"; the term "some embodiments" means "at least some embodiments". Definitions of the other terms shall be given in the following description.

It is to note that "a", "an", "one" and "several", "multiple" mentioned in the present disclosure is illustrative rather than restrictive, which one skilled in the art shall understand that unless indicated otherwise in the specification clearly, as "one or more".

It is to note that the term "first", "second" and other concepts mentioned in this disclosure are merely used to distinguish devices, modules or units, and are not intended to limit these devices, modules or units to different devices, modules or units. Units are also not used to limit the order or interdependence of functions performed by these devices, modules, or units.

In the embodiments of the present disclosure, description of message or information that multiple devices are communicating is merely illustrative, rather than limiting scope of the message or information.

Referring to FIG. 1, the present invention includes a rectangular mailbox 1 and flip door 2 provided on the mailbox 1, on the mailbox 1, an opening for flip door 2 installation is provided, inside the mailbox 1 is provided a storage cavity 3 for parcel storage, the opening is in communication with the storage cavity 3 and used for putting parcels in, the flip door 2 is provided on the opening and can be swung back and forth, and open the storage cavity 3; above the storage cavity 3 is provided a drop bucket 4, the drop bucket 4 is connected to the flip door 2 by a transmission mechanism, initially, the drop bucket 4 stays in one side of the storage cavity 3, by swinging the flip door 2 the drop bucket 4 will be driven open, to cover the storage cavity 3.

Specifically, the transmission mechanism includes a pair of symmetrically arranged connection rods 5, one end of each connection rod 5 is rotatably connected with the flip door 2, and the other end to the drop bucket 4; when the flip door 2 is swung, the drop bucket 4 could be driven by the connection rods 5 to swing.

Specifically, wherein the drop bucket 4 includes a baffle plate 41 and connection pieces 42 provided on both sides of the baffle plate 41, the connection pieces 42 are swingably connected to the side walls of the mailbox 1 through drop bucket supports 43. The baffle plate 41 is used to cover the opening of the storage cavity 3 and prevent mail being taken therefrom.

Specifically, the storage cavity 3 is internally provided with tension springs 6 which may retrieve the drop bucket 4 after swinging away, one end of the tension springs 6 is connected to the drop bucket support 43, and the other end thereof to the connection pieces 42 on the drop bucket, and when the drop bucket 4 is swung, the tension springs 6 could be stretched. By providing the tension spring 6, it is possible to return the swung drop bucket 4 back, which is convenient.

Specifically, the bottom of the flip door 2 is swingably fixed on the mailbox 1 via a rotating shaft, and when the flip door 2 is swung, a drop slot is formed between the top of the flip door 2 and the mailbox 1.

Specifically, a second drop slot 7 is provided on the flip door 2. Utilizing the second drop slot 7, it is not necessary to swing the flip door 2 to drop mail/letters or packages of small size or thickness.

Specifically, a limit bracket 8 is provided on each connection piece 42 to prevent it from protruding out of the storage cavity 3.

Figure 2:
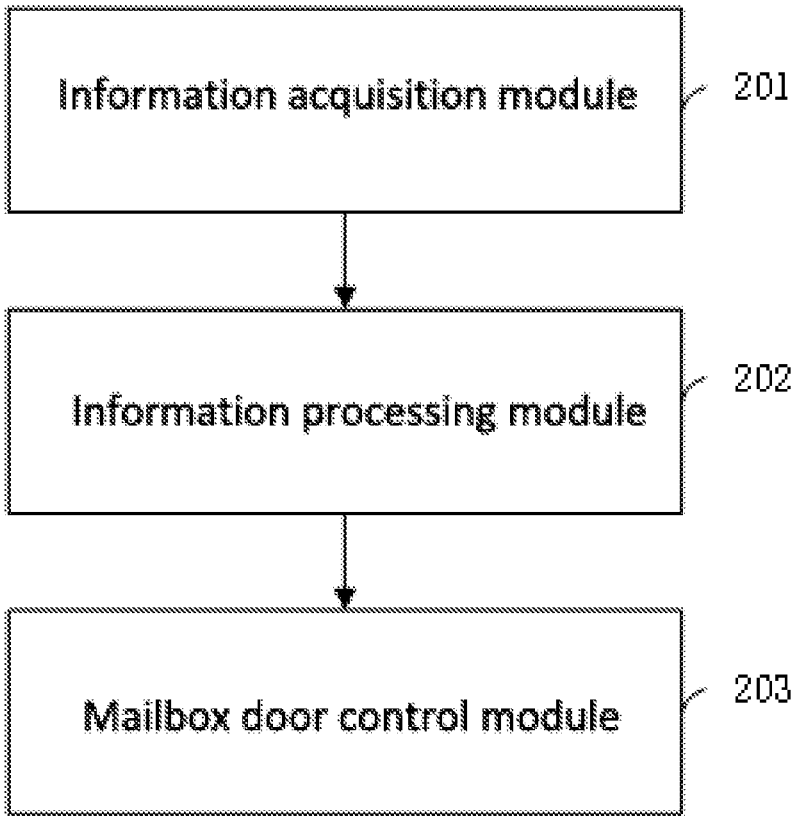
FIG. 2 is a schematic flowchart of the mailbox control system according to the present invention.

As an embodiment of the present invention, a mailbox control system is provided and as illustrated by the FIG. 2, the mailbox control system includes:

an information acquisition module 201 for acquiring outbound delivery/inbound delivery information, wherein the outbound delivery/inbound delivery information includes at least outbound delivery/inbound delivery address information, logistics company information, and outbound delivery/inbound delivery verification information;

an information processing module 202 for verifying whether the mailing verification information is consistent with the outbound delivery/inbound delivery store address information and the logistics company information;

an mailbox door control module 203 for opening the mailbox door for the users to drop and/or pick up mails when the mail delivery verification information is consistent with the mail outbound delivery/inbound delivery store address information and the delivery logistics company information;

As an embodiment of the present invention, an information acquisition module 201 is used for acquiring mailing information, wherein the outbound delivery/inbound delivery information includes at least outbound delivery/inbound delivery address information, logistics company information, and outbound delivery/inbound delivery verification information. As an embodiment of the present invention, the information acquisition module is an interaction module for acquiring external information, which could be a manual input device such as a keyboard, or a voice input device such as voice recognition facility, or a code scanning device to scan the identification code on the mail to acquire the outbound delivery/inbound delivery information. As an embodiment of the present invention, the mail outbound delivery/inbound delivery address information is the address information of both the sender and the recipient, and the mail logistics company information is the information of the logistics company that delivers the letters or packages. The logistics company could be selected by the user or randomly assigned by the system. The mail outbound delivery/inbound delivery verification information is verfying information used for mailing or collecting the mail. When the user needs to collect a letter or a package, it is necessary to show the verification information, which can be the user's identity information, or the mail collection verification code information. When the verification information and the recipient is correct, the mailbox door will open. And the user could be the recipient or the logistics company staff.

As an embodiment of the present invention, the information processing module 202 is a processor such as a single chip micyoco (SCM), a CPU, etc, used to process information acquired by the information acquisition module and communicate with the user terminal and the server. As a preferred embodiment of the present invention, when a user needs to deliver outbound parcel, he/she will fill the parcel information; and the information processing module processes the parcel information and uploads it to the server, the data are consequently transferred to the logistics company selected by the user or allocated by the server to ensure that the logistics company gets the parcel information, and controls the mailbox to print the receipt and paste it on the parcel. Then the information acquisition module acquires the parcel information and open the mailbox for the user to put the parcel in. When logistic staff comes to pick up the parcel, it is necessary to present the verification information of the logistics company. After acquiring the correct verification information from the logistic staff, the information processing module will determine whether the parcel can be released. When determining that the logistic staff is correct, it will open the door for him/her to collect the parcel.

As an embodiment of the present invention, the mailbox door control module 203 is a actuation mechanism and should at least include a locking structure, which could lock the mailbox door and when the information processing module determines that the sender or the recipient is eligible, control the mailbox door to open the mailbox door for users to send or pick up the mail.

The mailbox control system as provided by the embodiment of the present invention could read the verification information of the recipient. It will open the mailbox only when the verification information is eligible, which promises safety of the mail, and is safe and convenient.

The mailbox control system according to one embodiment of the present invention further includes:

a network connection module for establishing a network connection with a user;

a display module for showing running conditions of the mailbox and outbound delivery/inbound delivery information of the mail;

and an audio module for playing audio to a user according to the user operation.

As an embodiment of the present invention, the network connection module could be wireless network connection module which establishes communication with the server through the Internet, and establishes connection with the user terminal via the server; the network connection module could also be a LAN connection module, for example, establishing LAN connection with the user terminal via Bluetooth to ensure information transmission.

As an embodiment of the present invention, the display module could be a display screen which is used to display current running status of the mailbox and also the mail information in the mailbox, such as how many mails are to be picked up and how many to be sent, and users may check the mail delivery status via the display screen.

As an embodiment of the present invention, the audio module is used to play audio and help users to proceed. For example, when the user is to pick up the mail, play "Please show the QR code", and after the QR code is acquired by the information acquisition module, open the mailbox door and play "Please pick up your parcel" to remind the user.

The mailbox control system according to one embodiment of the present invention, could be connected to the user terminal via Internet, and communicate with users. When mail of a user arrives, the mailbox control system may notify the user, and connect with the user terminal via Bluetooth, so as to communicate with the user even when the user terminal is not connected to the Internet.

One embodiment of the present invention provides a mailbox control system with WIFI resetting function, wherein, the communication module is to receive the bluetooth connection request from the user terminal, and when bluetooth pairing is successful, send actuated order to the user terminal, and receive the service PIN from the user terminal, when the service PIN is correct, scan surrounding available WIFIs, connect and report to the user whether WIFI connection is successful by voice, and send a report of the WIFI connection status to the user terminal.

Another embodiment of the present invention provides a mailbox control system with firmware update function, wherein, the communication module is to receive the bluetooth connection request from the user terminal, and when bluetooth pairing is successful, send actuated order to the user terminal, and receive the service PIN from the user terminal, when the service PIN is correct, report to the user terminal that connection has been established and receive update instruction, and get the latest firmware version, and when the current version is not the latest one, download it and install, report to the user terminal that downloading and update is successful.

Another embodiment of the present invention provides a mailbox control system provided with device activation and binding function, wherein the communication module is to receive the bluetooth connection request from the user terminal, and when bluetooth pairing is successful, send actuated order to the user terminal, and receive the network connection order, scan existing network according preset network types, when there is cable network, send register request to the server, and report to the user terminal, to have the user terminal activated, set the mailbox to activated state, and produce certificate. When there is only WIFI, connect to it and when connection is successful, report the connection success by audio playing module and send register request to the server to complete device binding.

Another embodiment of the present invention provides a mailbox control system provided with device resetting function, wherein the communication module is to receive the bluetooth connection request from the user terminal, and when bluetooth pairing is successful, send actuated order to the user terminal, and receive the service PIN from the user terminal, when the service PIN is correct, report to the user terminal of the verification completion, and accept resetting order, while the mailbox control system controls the mailbox to reset, which includes renewing logs, network information, certificate and device state, removing local data and adding new device data, discontinuing binding with the existing user terminal, restarting device binding function and reset device binding process.

Figure 3:
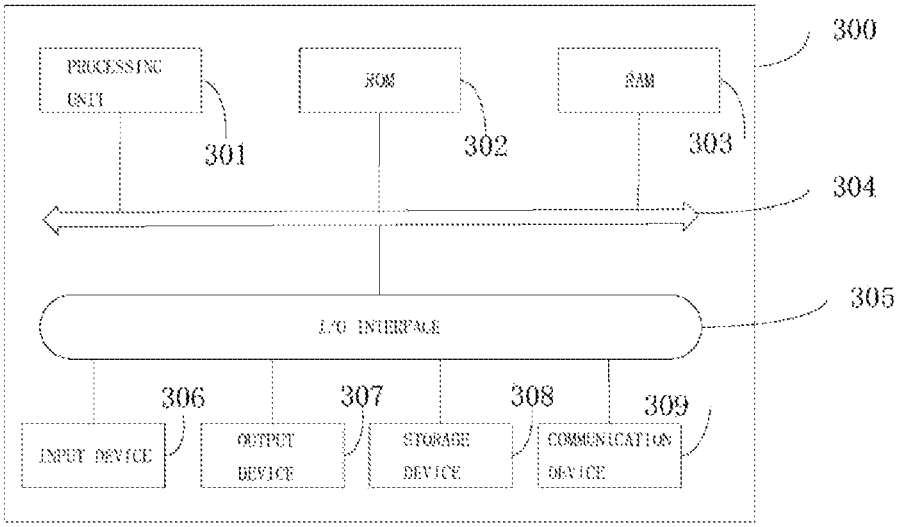
FIG. 3 is a schematic flowchart of the mailbox control module according to the present invention.

As per FIG. 3, wherein a schematic structural flowchart of mailbox control module 300 of embodiments of the present disclosure is shown. The terminal device according to embodiments of the present disclosure can be but not limited to mobile terminals such as mobile phone, notebook computer, digital broadcast receiver, personal digital assistant (PDA), panel computer (PAD), portable multimedia player (PMP), car-mounted terminal (such as car-mounted navigation terminal) and fixed terminal such as digital TV and desktop etc. Electronic devices shown in FIG. 3 serves only as example, which shall not confer any limitation to the functions and application of embodiments of the present disclosure.

The mailbox control module includes: memory and processor, wherein, the processor can be a processing unit 301 as mentioned in the following paragraphs, and the memory may comprise at least one of read-only memory (ROM) 302, random access memory (RAM) 303 and storage device 308, which works in the following way:

As is shown in FIG. 3, the mailbox control module 300 may comprise a processing unit (such as CPU, GPU etc.) 301, which may execute programs stored in the ROM 302 or RAM 303 loaded from the storage device 308 and take corresponding action. In the RAM 303, there are programs and data necessary for using the electronic device 300. Processing device 301, ROM 302 and RAM 303 are interconnected by bus 304. The input/output interface (I/O interface) 305 is also connected to the bus 304.

Generally, the following devices could be connected to the I/O interface 305: inputting device 306 such as touch screen, touch pad, keyboard, mouse, camera, microphone, accelerometer, and gyroscope etc.; outputting device 307 such as liquid crystal display (LCD), loudspeaker, and vibrator, etc.; storage device 308 such as magnetic tape and harddisk etc.; and communication device 309. The communication device 309 may allow the electronic device 300 to communicate with other devices wiredly or wirelessly to make data exchange. Although in FIG. 3, a mailbox control module 300 with all kinds of devices is shown, it shall be understood that it is not required to have all of the shown devices, it is eligible to have more or less devices than shown herein and replacement and variation is possible.

The foregoing description is only an explanation to the preferred embodiments of the present disclosure and technical principles thereof. It will be apparent to one skilled in the art that scope of the present disclosure is not limited to the precise embodiment of the specific combination of the technical features, in the meantime, other technical implementations of combinations of the above technical features and/or their equivalents without departing from the spirit and scope of the present disclosure fall also within the protection scope of the claimed subject matter. For example, technical embodiments resulted from (but not limited to) replacement by technical features of similar functions disclosed herein of those described above are also covered.

Moreover, while operations are depicted in a particular order, this should not be understood as requiring that such operations be performed in the particular order shown or in sequential order. Similarly, while this disclosure contains many specifics of the embodiments, these should be not construed as limitations on the scope of the invention. Certain features that are described in this specification in the context of separate implementations can also be implemented in combination in a single implementation. Conversely, various features that are described in the context of a single implementation can also be implemented in multiple implementations separately or in any suitable subcombination.

Although language particular to structural features and/or methods, logics and actions has been employed to describe the subject matter, it shall be understood that the subject matter claimed in the appended claim is not necessarily limited to the specific features and actions described above. On the contrary, the specific features and actions are merely exemplary embodiments of the claimed subject matter.

The invention claimed is:

1. A novel mailbox, including a mailbox [1] and a flip door [2] arranged on the mailbox [1], and the flip door [2] is provided with a drop slot [7], the mailbox [1] is internally provided with a storage cavity [3] for storing mail, the flip door [2] is capable of swinging and opening the storage cavity [3], wherein a drop bucket [4] is swingably provided above the storage cavity [3], the drop bucket [4] and the flip door [2] are connected via a transmission mechanism, and when the flip door [2] is swung, the drop bucket [4] is driven to cover the storage cavity [3];

wherein the transmission mechanism includes a pair of symmetrically arranged connection rods [5], one end of the connection rods [5] is rotatably connected with the flip door [2], and the other end to the drop bucket [4]; when the flip door [2] is swung, the drop bucket [4] is driven by the connection rods [51 to swing;

wherein the drop bucket [4] includes a baffle plate [41] and connection pieces [42] provided on both sides of the baffle plate 1411, the connection pieces [42] are swingably connected to side walls of the mailbox [1] through drop bucket supports [43];

wherein each connection piece [42] is provided with a limit bracket [8] for limiting the connection piece [42] from protruding out of the storage cavity [3].

2. The novel mailbox of claim 1, wherein the storage cavity [3] is internally provided with tension springs [6] which retrieve the drop bucket [4] after swinging away, one end of the tension springs [6] is connected to the drop bucket support [43], and the other end thereof to the connection pieces [42] on the drop bucket [4], and when the drop bucket [4] is swung, the tension springs [6] are stretched.

* * * * *